US006561385B1

(12) United States Patent
Jacobs

(10) Patent No.: US 6,561,385 B1
(45) Date of Patent: May 13, 2003

(54) TOOTHPASTE TUBE FOLD-HOLDER

(76) Inventor: Harry O. Jacobs, 3028 Mathers Mill Rd., Lafayette Hill, PA (US) 19444

( * ) Notice: Subject to any disclaimer, the term of this patent is extended or adjusted under 35 U.S.C. 154(b) by 0 days.

(21) Appl. No.: 10/117,230

(22) Filed: Apr. 8, 2002

(51) Int. Cl.[7] ..... B65D 35/32
(52) U.S. Cl. ..... 222/99; 222/95; 222/97; 222/103
(58) Field of Search ..... 222/95, 97, 99, 222/103

(56) References Cited

U.S. PATENT DOCUMENTS

| | | | | | |
|---|---|---|---|---|---|
| 1,212,138 | A | * | 1/1917 | Glasow et al. | 222/93 |
| 2,638,251 | A | * | 5/1953 | Houldsworth | 222/97 |
| 3,138,292 | A | * | 6/1964 | Hanna | 222/99 |
| 3,269,603 | A | * | 8/1966 | Reiman | 222/103 |
| 3,628,696 | A | * | 12/1971 | Duiker | 222/99 |
| 4,576,314 | A | | 3/1986 | Elias et al. | 222/97 |
| 4,817,823 | A | | 4/1989 | Sparr, Sr. | 222/103 |
| 4,976,380 | A | | 12/1990 | von Schuckmann | 222/103 |
| 5,014,879 | A | * | 5/1991 | Hill | 222/99 |
| 5,082,144 | A | * | 1/1992 | Sundstrom | 222/99 |
| 5,108,008 | A | * | 4/1992 | Ryder | 222/99 |
| 5,472,118 | A | * | 12/1995 | Nelson | 222/99 |

* cited by examiner

*Primary Examiner*—J. Casimer Jacyna
(74) *Attorney, Agent, or Firm*—Gregory J. Gore

(57) ABSTRACT

A clip is provided for a dispensing tube about which the collapsed end of the tube may be wrapped. The clip is substantially rectangular and includes a plurality of transfer ducts, at least one on each of a top and a bottom edge. The ducts are accessible from the side of the folded dispensing tube so that one leg of a retainer pin can be inserted into a duct, the second leg of the pin forceably contacting the outside surface of the tube. Thus, the pin maintains the position of the folded tube against the clip and prevents it from unraveling. The clip is generally rectangular and as the collapsed end of the tube is folded up to the next position, the pin is moved from one duct at one side of the clip to the other side of the clip.

9 Claims, 3 Drawing Sheets

TOOTHPASTE TUBE FOLD-HOLDER

FIELD OF THE INVENTION

The present invention relates to a dispenser tube roll-up device which facilitates the compacting of the closed end of the tube as material is dispensed over time. More specifically, it relates to an apertured clip and securement means around which the tail end of the tube is held in folded-up condition.

BACKGROUND OF THE INVENTION

All popular toothpaste is water based. When toothpaste was first marketed, it was dispensed from tubes made of thin lead sheet. This material felt cool and when rolled up, as toothpaste was pushed out, it stayed neatly rolled up. However, a problem developed with using thin lead sheet to make tubes for toothpaste. Lead could be leached from the inside of the thin lead sheet tubes, into the toothpaste. Lead in a human mouth from toothpaste can possibly enter the brain and cause harmful medical conditions, including irreversible mental retardation.

To solve this problem, manufacturers of toothpaste substituted thin plastic sheet to make toothpaste tubes. Plastic tubes look good, feel good, and there is absolutely no danger of lead ever getting into the toothpaste from the plastic tubes. However, there is a problem with plastic toothpaste tubes. They refuse to stay rolled up and unroll into various contorted, undesirable shapes. Also, because they do not stay rolled up, it is difficult to squeeze all usable toothpaste from the plastic tube, as some toothpaste keeps moving back into the unrolled tube. This wastes usable toothpaste.

It has been known to hold the folds of the tail end of the toothpaste tube together by using a simple hairpin clip around the last fold. Another type of clip used in this fashion is disclosed, for example, in U.S. Pat. No. 4,817,823 issued to Sparr. In another type of clip, as disclosed for example in U.S. Pat. No. 4,576,314 issued to Elias et al., a turn key is used to roll up the tail end of the toothpaste tube inside of the cavity of a large surrounding clip. Yet another type of dispensing tube clip disclosed in U.S. Pat. 4,976,380 issued to von Schuckmann. This clip also forms a stand to hold the toothpaste tube vertically.

While these various prior art devices attempt to solve the problem of holding the tail end of a toothpaste tube in a folded condition, they are either bulky and complex or aesthetically unattractive. Furthermore, the structures of the devices of the prior art often create areas which can accumulate debris and therefore are either unsanitary or are difficult to clean. There is therefore a need in the art for a toothpaste tube fold-holder which holds the tail end of the toothpaste tube in a folded condition which is simple, attractive, inexpensive, easy to use, and sanitary.

SUMMARY OF THE INVENTION

In order to solve the need in the art described above, a dispensing tube fold-holder has been devised. The invention includes a clip about which the collapsed end of the tube is wrapped. The clip is substantially rectangular and includes a plurality of transverse ducts, at least one on each of a top and a bottom edge. In use, the ducts are accessible from the side of the folded dispensing tube so that one leg of a retainer pin can be inserted into a duct with the second leg of the pin forceably contacting the outside surface of the tube. Thus, the pin maintains the position of the folded tube end against the clip and prevents it from unraveling. The overall dimension of the clip is generally rectangular so that the collapsed tube wound around the clip is more folded than rolled. As the collapsed end of the dispenser tube is folded up to the next position, the pin is alternatingly positioned from a duct at one side of the clip to the other side of the clip. Because the clip is internal to the folds, it is not visible and provides a neat overall appearance. In one embodiment, the clip may be formed from white anodized aluminum stock of the type used to make house roof edging. The clip includes opposing sideplates which hold the distal end of the tube between them. Also, the associated pin is formed from metal stock of the type used to make household bobby pins and is preferably colored the same as the dispensing tube so that the clip and pin combination is hardly visible.

More specifically, the applicant has invented a dispensing tube fold-holder which includes a substantially rectangular clip having a plurality of ducts, at least one of said ducts lying along each of a top edge and a bottom edge of the clip. A resilient retaining pin having two legs is inserted into one of the ducts and a second leg thereby forceably contacts the outside surface of the collapsed end of the dispensing tube when the end of the tube is folded about the top and bottom edges of the clip. The clip also includes two opposite facing sideplates which are joined at a centerfold along the top edge of the clip. The inside surface of the centerfold forms one of the ducts. The other ducts are formed along the bottom edge of each of the sideplates on a side of the clip opposite the centerfold duct. A resilient cavity between the opposite facing sideplates receives the end of the toothpaste tube and clasps it since the sideplates are preferably resiliently biased toward each other, while almost touching and almost parallel.

This simple mechanical device therefore satisfies the need in the art for a mechanism which holds the tail end of dispensing tubes, such as toothpaste tubes, in their rolled-up or folded-up condition. As a further objective, it provides the retention of the folded condition of the tube in a neat and aesthetically pleasing way since only a very small portion of the device is visible. To meet yet another objective, the present device may be manufactured very inexpensively and it is extremely easy to use. Other objectives and advantages will become apparent from the following drawings and description of the preferred embodiment.

DESCRIPTION OF THE PREFERRED EMBODIMENT

Figure 1:
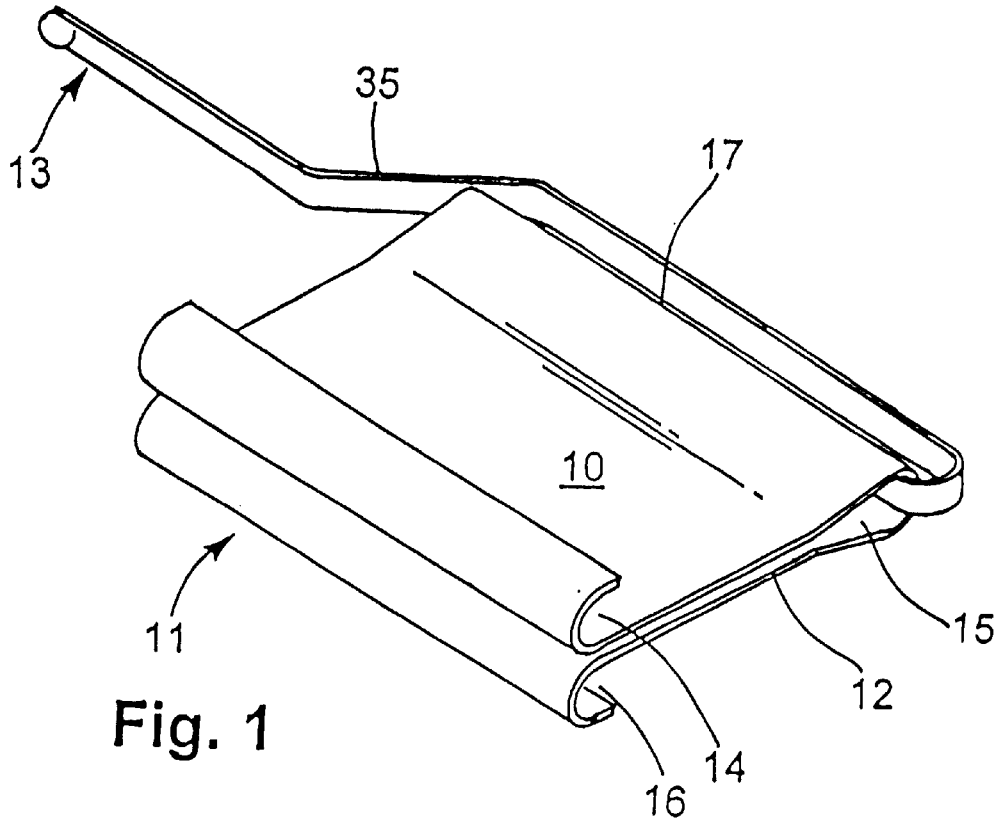
FIG. 1 is a top right front isometric view of two components of the present invention in their assembled condition.

Referring now to FIG. 1, the clip 11 and retaining pin 13 are depicted in their assembled condition. In the preferred embodiment, the clip 11 is formed of a single piece of sheet metal bent into the configuration as depicted. In this embodiment, the clip is substantially rectangular and has a single pin-receiving duct 15 at a centerfold 17 in the sheet metal along one edge, and two ducts 14 and 16 along an opposite edge of the clip formed by rolling the ends of each of the sideplates 10 and 12. The clip is initially installed by placing the distal end of the dispenser tube between the sideplates.

Figure 2:
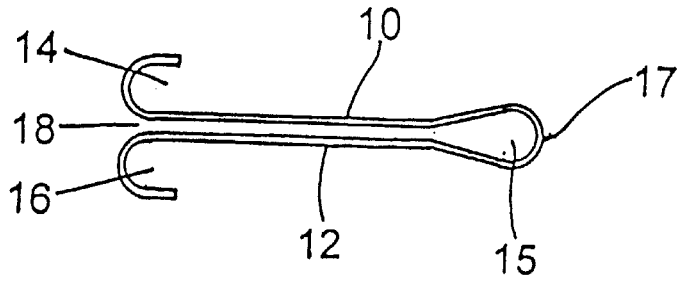
FIG. 2 is a side view of the clip component of the present invention.

As shown more clearly in FIG. 2, the clip sideplates 10 and 12 are joined at the centerfold 17 and the interior of the fold is enlarged to form a first duct 15. Second and third ducts, 14 and 16, are formed by rolling the ends of each sideplate. When formed in this fashion, the clip includes a central cavity 18 between the sideplates at the front for receiving the end of the dispenser tube as will be more clearly depicted with regard to FIGS. 4 through 6.

Figure 3:
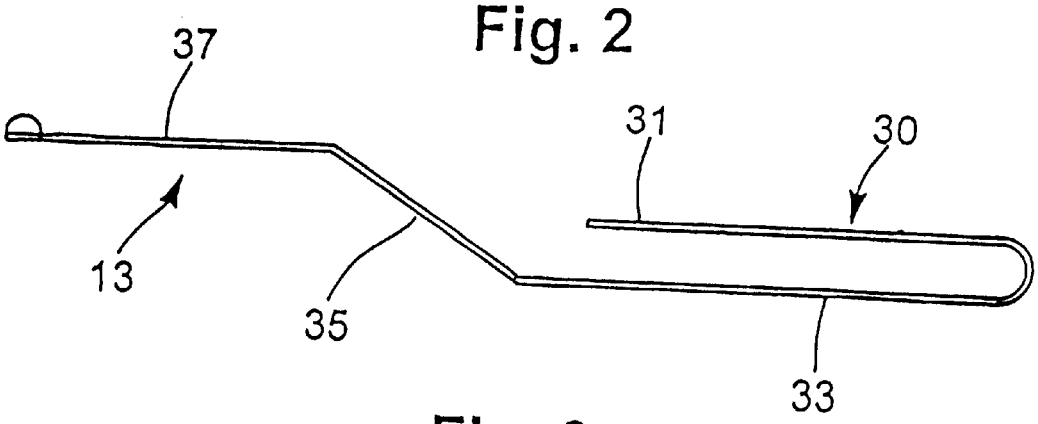
FIG. 3 is a top view of the retaining pin component of the present invention.

Referring now to FIG. 3, a top view of the retainer pin as shown in FIG. 1 includes a clip-engaging section 30 that provides opposite-facing resiliently-biased legs 31 and 33 and an angled central portion 35 that produces an offset for extension 37 which is substantially parallel to legs 31 and 33. While only two components of the invention have been depicted herein, namely the clip and a single retaining pin, it will be understood by those of skill in the art that multiple pins installed into different ducts may be employed.

Figures 4, 5, 6:
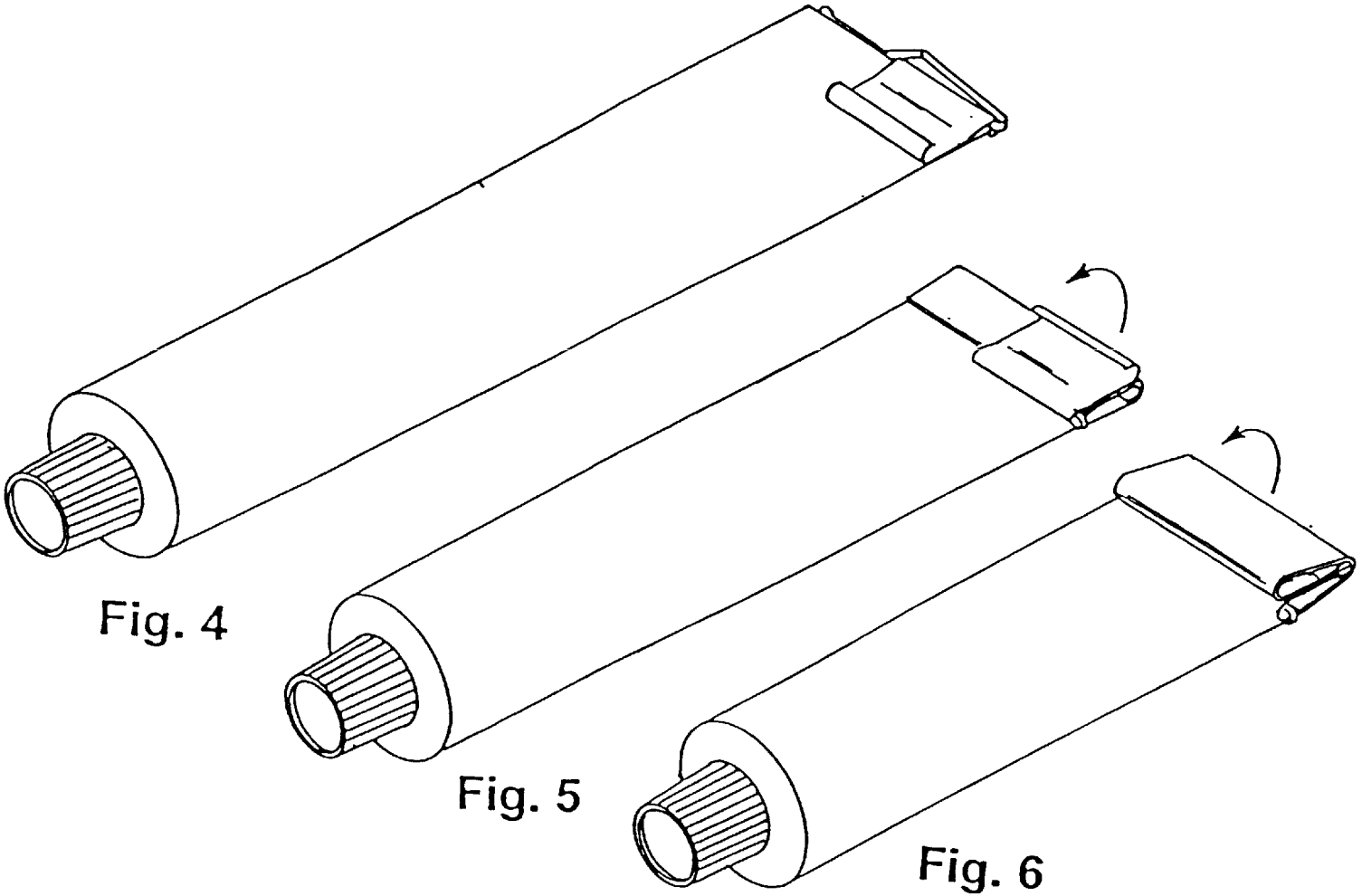
FIGS. 4, 5, and 6 are top right front perspective views of three sequential positions of the present invention in use.

Referring now to FIGS. 4 through 6, the present invention is shown in use at successive positions as the dispensing tube is collapsed at the tail end and wrapped about the clip. As shown in the drawings, the clip need not be as wide as the full width of the tube to function properly. Therefore, tubes of varying width may be accommodated by components of the invention of a single size. In FIG. 4, the initial attachment of the clip to the end of the dispenser tube is shown. The opposite sides of the clip provide some resilience in this position to hold the distal end of the tube in the collapsed condition between the sideplates along a small portion of its length at the end. In this embodiment, the clip also functions as a clasp as well as a core element about which a collapsed end of the dispenser tube is wrapped. In this position, the angled portion of the pin prevents the pin from falling out of the clip since it bears against the end of the clip. In addition, because the two sideplates are identical, the clip is reversible so that it cannot be incorrectly installed on the end of the tube.

FIG. 5 shows the tube wrapped about the clip in a first 180-degree turn of the clip. The retainer pin is positioned in the centerfold duct of the clip and clasps the outside surface of the tube firmly against the clip. Because the clip already holds the distal end of the tube which is captured between the plates, the tube is firmly held in this position.

Referring now to FIG. 6, in the next position the clip is rotated again 180 degrees which captures another length of dispenser tube. Compared to FIG. 5, the retainer pin is now moved to the opposite side edge of the plate into one of the ducts formed along that edge. In this way, successive wraps of the tube around the clip alternatingly move the pin between ducts along opposite side edges of the clip. The pin resiliently grips the collapsed portion of the tube against the clip and holds the tube from unfolding.

Figure 7:
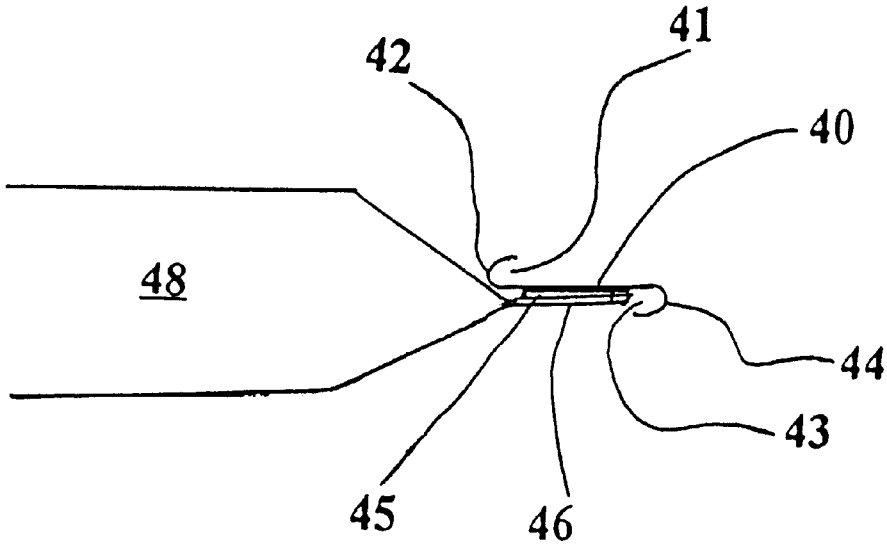
FIG. 7 is a side view of an alternate embodiment of the invention.

Referring to FIG. 7, a simplified alternate embodiment is shown in which the clip structure shown in FIGS. 1–6 is replaced by a simple, rectangular plate 40 with reverse curve bends 42 and 44 at opposite sides. The dimensions of the plate are substantially the same as one of the sideplates of the previous embodiment. The bends form ducts 41 and 43 that function with the pin shown in FIG. 3 exactly as the clip version. The body of the plate is attached to the flat end 46 of the dispensing tube 48 by an adhesive 45. Stapling, crimping, or any other logical method of attachment may also be employed by the manufacturer of the tube.

It will be apparent, therefore, that the objects of the present invention have been achieved by the preferred embodiment shown herein. The invention holds the end of a toothpaste tube in its folded condition and is simple, attractive, inexpensive, easy to use, and sanitary. Other modifications may be made which will be obvious to one of skill in the art from the description of the preferred embodiment, however the scope of the applicant's invention should be limited only by the following claims and their legal equivalents.

What is claimed is:

1. A dispensing tube fold-holder, comprising:

a substantially rectangular clip having a plurality of ducts, at least one of said ducts lying along each of a top edge and a bottom edge of said clip; and a resilient retaining pin having two legs, one leg inserted into one of said ducts and a second leg forceably contacting the outside surface of the collapsed end of a dispensing tube when said end of said tube is folded about the top and bottom edges of said clip.

2. The holder of claim 1 wherein said clip further includes two opposite-facing sideplates which are joined at a centerfold along the top edge of said clip.

3. The holder of claim 2 wherein a first of said ducts lies along the inside surface of said centerfold.

4. The holder of claim 3 wherein a second of said ducts lies along the bottom edge of one of said sideplates opposite said edge of said centerfold.

5. The holder of claim 4 further including a cavity which lies between said opposite-facing sideplates.

6. The holder of claim 5 wherein said sideplates are substantially parallel and resiliently biased toward each other.

7. A dispensing tube fold-holder, comprising:

a substantially rectangular plate having two ducts, one of said ducts lying along each of a top edge and a bottom edge of said plate; and a resilient retaining pin having two legs, one leg inserted into one of said ducts and a second leg forceably contacting the outside surface of the collapsed end of a dispensing tube when said end of said tube is folded about the top and bottom edges of said plate.

8. The dispensing tube fold-holder of claim 7, wherein said ducts lie within bends in said plate.

9. The dispensing tube fold-holder of claim 8 further including a dispensing tube to which said holder is affixed at a collapsed end of said tube by an adhesive.

* * * * *